US012685423B2

(12) United States Patent
Bateham et al.

(10) Patent No.: US 12,685,423 B2
(45) Date of Patent: Jul. 21, 2026

(54) CLEANING MACHINE ERGONOMIC HANDLE

(71) Applicant: Cintas Corporate Services, Inc., Cincinnati, OH (US)

(72) Inventors: Jason Bateham, Savannah, GA (US); Fady Rafla, Pooler, GA (US); Kyle Thomas, Monroe, OH (US); Rex Michael Tyler, Ft. Thomas, KY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 376 days.

(21) Appl. No.: 18/426,519

(22) Filed: Jan. 30, 2024

(65) Prior Publication Data

US 2025/0241501 A1 Jul. 31, 2025

(51) Int. Cl.
*A47L 11/40* (2006.01)

(52) U.S. Cl.
CPC ..... *A47L 11/4075* (2013.01)

(58) Field of Classification Search
CPC .. A47L 11/12; A47L 11/4036; A47L 11/4069; A47L 11/4075; A47L 11/4038; A47L 11/4044; A47L 11/4061; A47L 5/30; A47L 9/32; A47L 7/0004; A47L 13/05; A47L 9/327; A47L 9/248; A61G 5/10; B25G 1/10; B25G 1/102; B25G 3/38; B25G 1/06; B25G 3/00; B25G 1/00; A45B 9/02; Y10S 16/12; Y10S 16/19; E01H 1/02
USPC ..... 15/98, 49.1, 320, 50.1, 410, 145, 353, 15/143.1, 22.1, 176.2, 52.2, 381, 321, 15/415.1, 50.2, 246, 257; 16/430, 422, 16/438
See application file for complete search history.

(56) References Cited

U.S. PATENT DOCUMENTS 5,065,475 A * 11/1991 Watt ..... B25G 1/00 294/58
10,368,710 B1 8/2019 Robinson et al.
2004/0019989 A1* 2/2004 Zahner ..... A47L 11/4069 15/50.2
2004/0083579 A1* 5/2004 Furr-Britt ..... A47L 9/325 16/421

(Continued)

OTHER PUBLICATIONS

Argubi-Wollesen, Andreas, et al., "Human Body Mechanics of Pushing and Pulling: Analyzing the Factors of Task-related Strain on the Musculoskeletal System," ScienceDirect, OSHRI, Safety and Health at Work 8 (2017) 11-18, available on-line Aug. 1, 2016, www.e-shaw.org, 8 pages.

(Continued)

*Primary Examiner* — Monica S Carter
*Assistant Examiner* — Sarah Akyaa Fordjour
(74) *Attorney, Agent, or Firm* — FBT Gibbons LLP

(57) ABSTRACT

An ergonomically designed handle for cleaning machines and other applications may be provided as original equipment or as a retrofit item to minimize physical effort and discomfort while maximizing efficiency during the operation and transport of cleaning machines. The handle of this invention may be conveniently mounted and assembled onto the existing handle structure of the cleaning machine and once installed, provides an ergonomic grip for a variety of user profiles to reduce strain and discomfort when operating and transporting the cleaning machine. The handle has two mounting plates each with a handlebar mounted thereto.

18 Claims, 5 Drawing Sheets

(56) References Cited

U.S. PATENT DOCUMENTS

| | | | | |
|---|---|---|---|---|
| 2013/0263438 | A1* | 10/2013 | Burns | A61B 8/58 16/422 |
| 2021/0086342 | A1* | 3/2021 | Cohen | B25G 1/04 |

OTHER PUBLICATIONS

Kaivac, KaiVac 1750 Mid-Size No-Touch Cleaning Machine, www.kaivac.com/shop/kv1750, 1 page.

* cited by examiner

CLEANING MACHINE ERGONOMIC HANDLE

This invention relates to the inventions disclosed in U.S. Provisional Patent Application Ser. No. 63/416,631, filed Oct. 17, 2022 and hereby incorporated by reference in its entirety.

BACKGROUND OF THE INVENTION

This invention relates to cleaning machines, and more particularly, to an improved ergonomic handle for use on a cleaning machine.

Mobile cleaning machines are commonly used in commercial and industrial settings for cleaning bathrooms, kitchens and other areas. One example of such a cleaning machine is disclosed in U.S. Pat. No. 10,368,710 which is incorporated herein by reference in its entirety. Such machines by their very nature are mobile and pushed around from setting to setting for cleaning by a user. As such, machines of these and other types are commonly equipped with wheels for the rolling transport of the machine. A handle is also commonly provided on such machines for an operator to grasp and push, pull, turn and generally maneuver the machine from place to place. An operator may use the machine for hours on end and typically throughout an eight hour or so work shift cleaning the various commercial and industrial facilities.

The ease with which the machine may be transported and manipulated is of paramount importance for the healthy and efficient operation thereof by the user. In some machine designs, the placement of the handle requires an operator to bend over in a hunched position to both grasp the handle and maneuver the machine while grasping the handle, see FIGS. 1-2. Handle placement and overall machine design may be compatible with an operator of first physical stature while such placement and design is not convenient or comfortable for an operator of a different physical stature.

Many industrial machines and workspaces in general have been redesigned to replace the carrying of objects by tasks that require pushing or pulling. According to literature, these tasks could end up leading to the development of musculoskeletal disorders (MSDs), presumably due to high loads and/or frequent task repetition. A current analysis in the industrial sector has shown that about 10% of all working processes involve pushing and pulling on a regular and repetitive basis, with a great share (41.2%) requiring the manipulation of objects with total masses between 200 kg and 1,000 kg.

When operating these cart masses, which have to be maneuvered manually by hand, the exerted forces create joint torque, joint compression, and joint shear. In many cases, the hazards of handling heavy loads manually have not been contained properly to date. Accordingly, "best practice" recommendations on how to ergonomically operate carts and create a functional grip design are still insufficient.

In the challenge to reduce MSD prevalence, research has focused on how the pushing and pulling task intensity is related to these internal strain factors at injury-prone body locations such as the knees, the shoulders, and the lower back. The task intensity is commonly quantified by measuring muscle activation response and hand or ground forces and is dependent on the configuration of the hand-object interface (mostly a set of handles attached to the object). Likewise, to assess biomechanical load these parameters have to be quantified in terms of intensity, duration, and frequency. Handle configurations like different handle heights, influence how forces can be applied to the cart by the person maneuvering it. Consequently, handles potentially allow for the reduction of task intensities and internal biomechanical strain as shown in a reduction of required forces at the hands which lead to a decreased muscle activation response between comparable tasks.

Conclusions from task intensity on biomechanical strain are drawn by body segment models that calculate estimates of torques, compressions, and shear forces. Some studies showed results that have been derived psychophysically by using the concept of maximum acceptable force to quantify physical strain. The values for an acceptable force level are obtained when the individuals' perception of the task (acceptable strain) meets specific additional information (e.g., single task performed once in an 8-hour shift). See, *Safety and Health at Work*, Vol. 8, Issue 1, March 2017, p. 11-18.

Therefore, an improved handle design for commercial and industrial cleaning machines which addresses these and other shortcomings in the prior art to minimize physical effort and discomfort, and hence maximize efficiency, during the operation and transport of such machines is needed.

SUMMARY OF THE INVENTION

These and other objectives have been addressed by this invention which is an ergonomically designed handle for cleaning machines and other applications. This invention may be provided as original equipment or as a retrofit item to minimize physical effort and discomfort while maximizing efficiency during the operation and transport of cleaning machines, such as those shown in U.S. Pat. No. 10,368,710, as an example.

The handle according to various embodiments of this invention does not require the dismantling, removal or modification of any of the existing structure or components of the known cleaning machines. The handle of this invention may be conveniently mounted and assembled onto the existing handle structure of the cleaning machine and once installed, provides an ergonomic grip for a variety of user profiles to reduce strain and discomfort when operating and transporting the cleaning machine.

In one embodiment of this invention, the handle has two mounting plates each with a handlebar mounted thereto. The handlebar in one embodiment is a generally U-shaped structure with a proximal end secured to one of the mounting plates and the distal end terminating in an out turned grip. The mounting plates and handlebars may be mirror images of one another and secured to each other and the cleaning machine by a number of threaded rods or bolts. Each mounting plate may have a pair of specially designed apertures to allow the existing cleaning machine handle and other structure to project through the respective aperture for securely and releasably mounting the handle to the cleaning machine.

Other shapes, designs and embodiments of the handle according to various embodiments of this invention may be provided within the scope of this invention to offer the above stated ergonomic benefits.

Other aspects of this invention include not only the handle itself, but a method of installing, using and removing a handle from the cleaning and other machines to achieve such ergonomic benefits.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
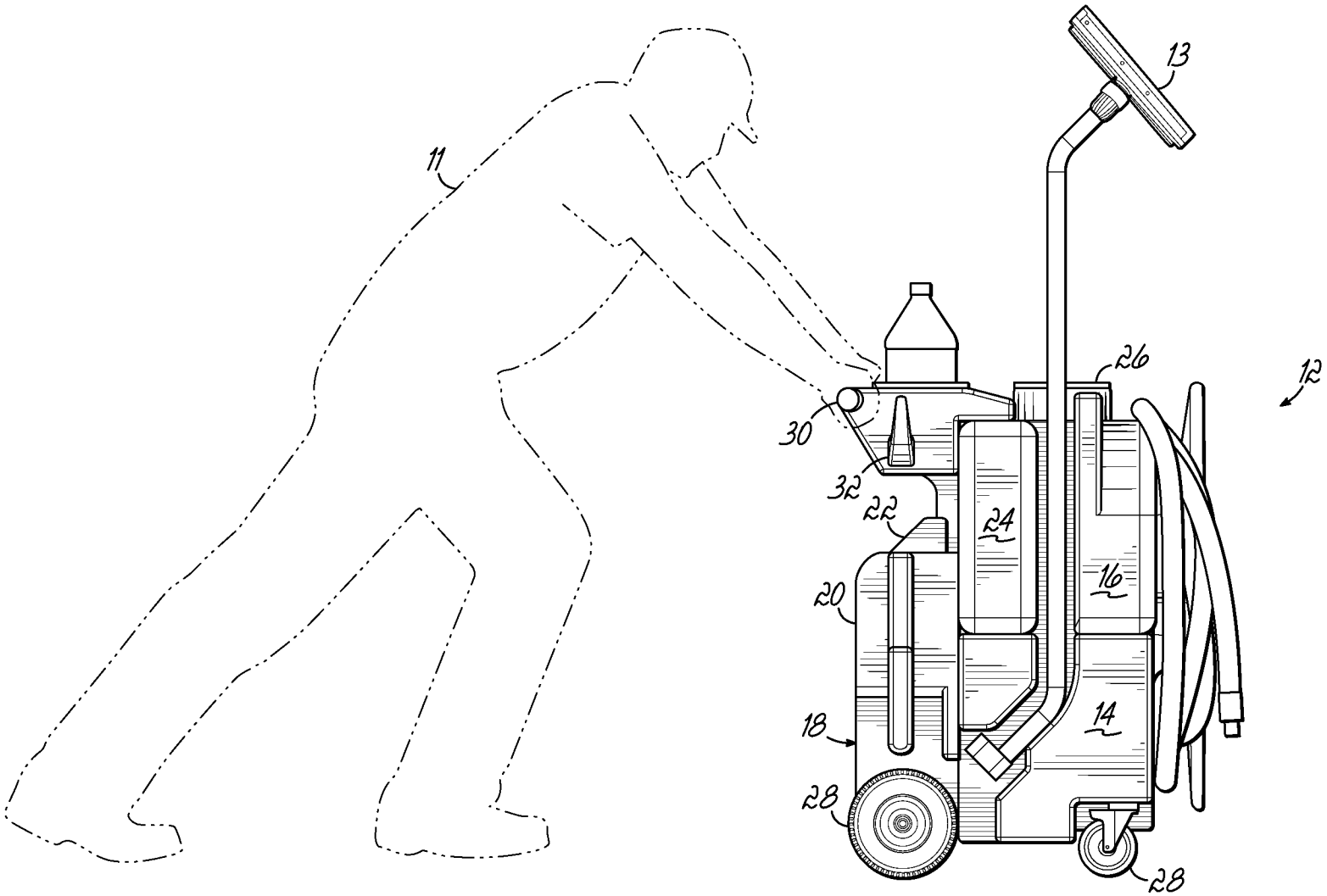
FIG. 1 is side elevational view of a user pushing an exemplary cleaning machine without a handle according to this invention.
Figure 2:
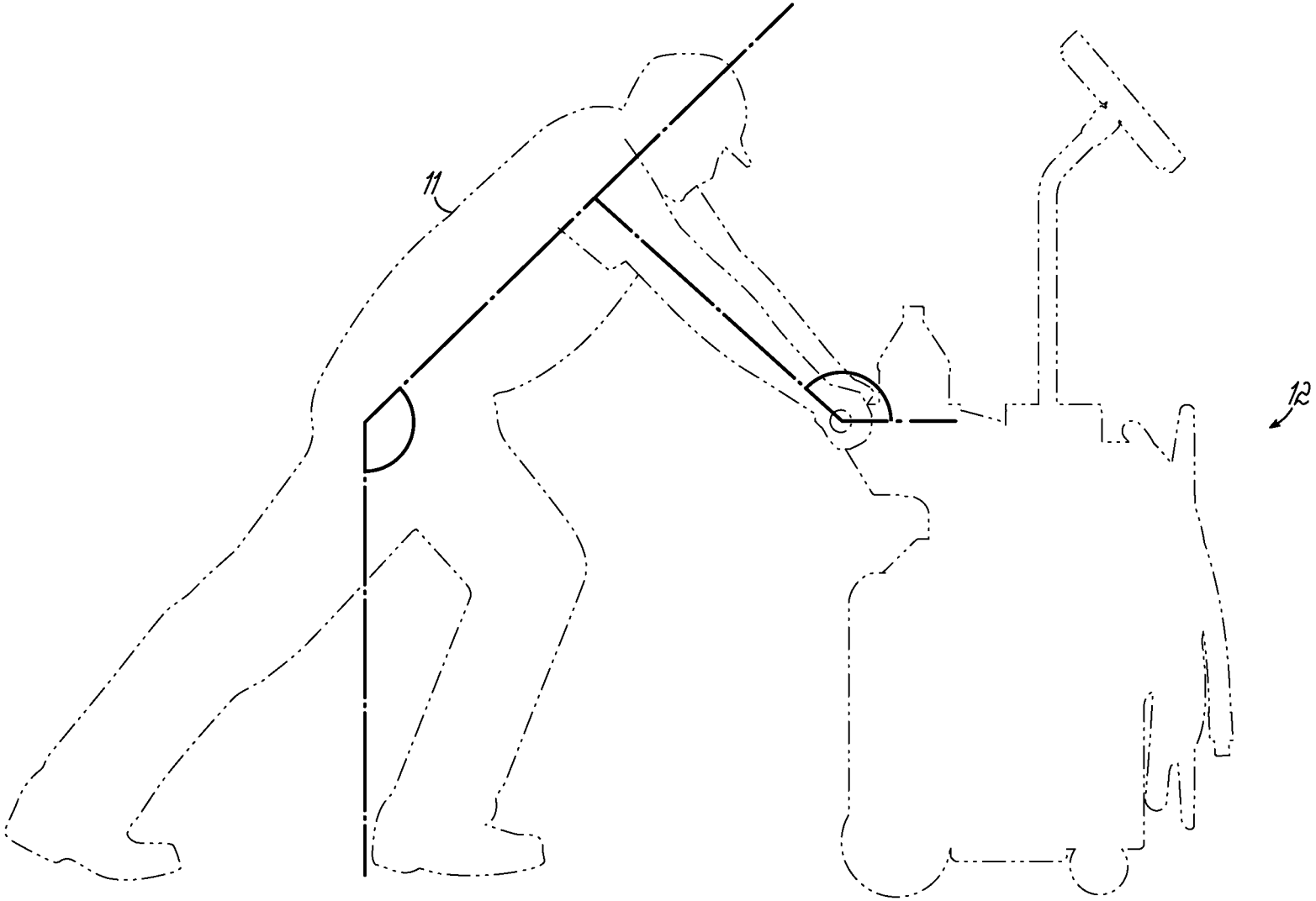
FIG. 2 is a view similar to FIG. 1 including a free-body diagram of the orientation of forces exerted by the user to push the cleaning machine.
Figure 3:
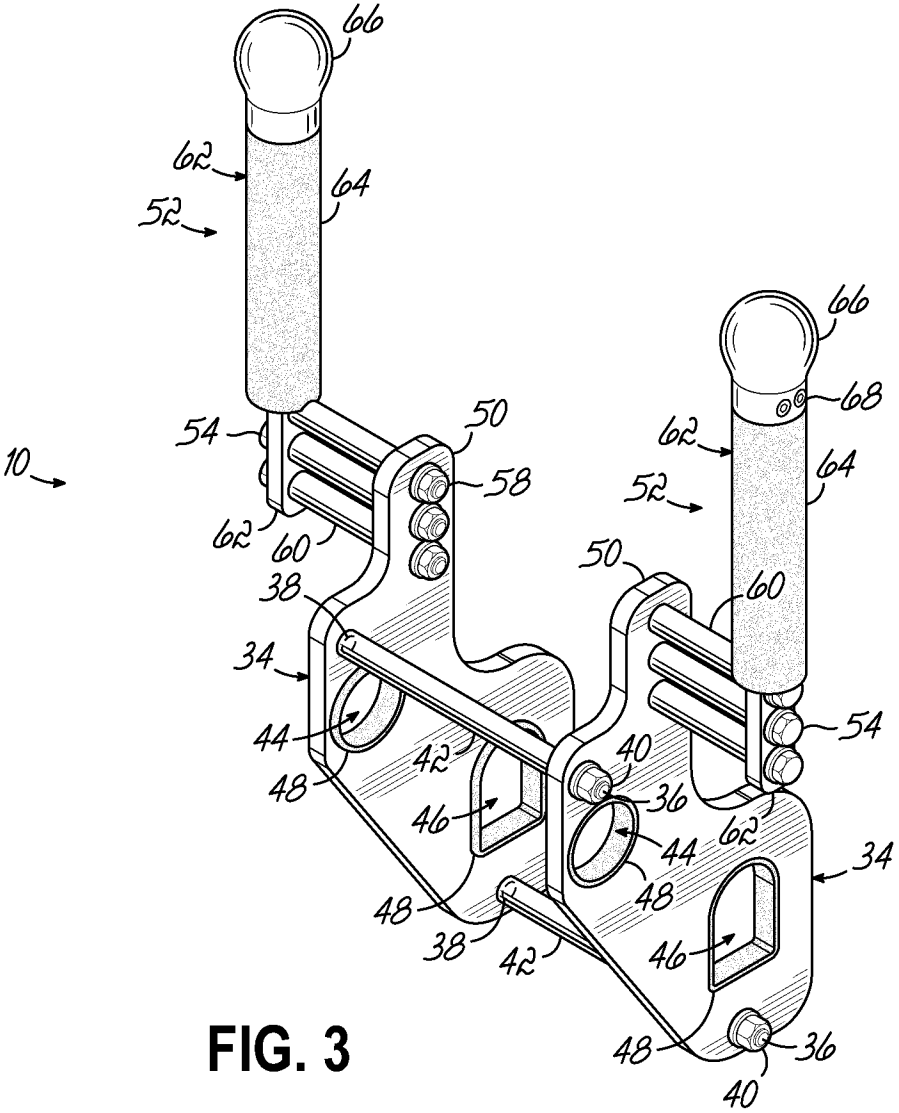
FIG. 3 is a perspective view of one embodiment of a handle according to this invention for use on the cleaning machine.
Figure 5:
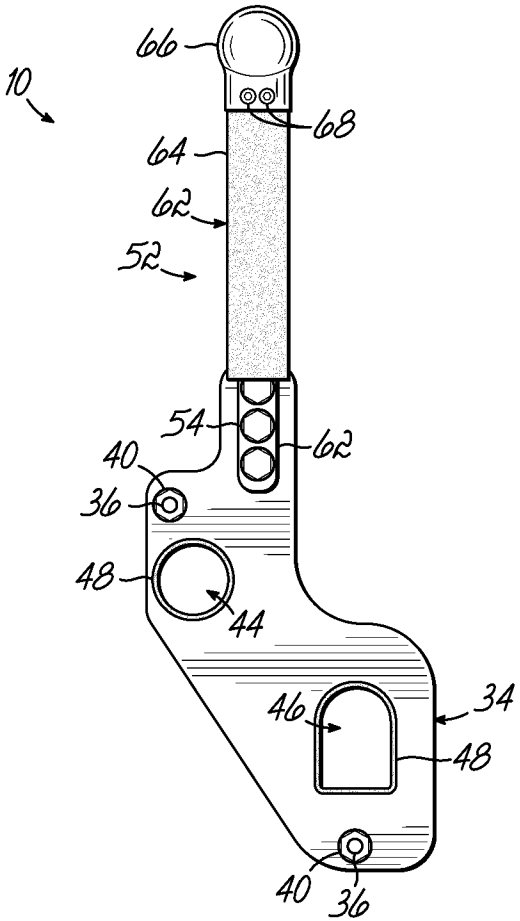
FIG. 5 is a side elevational view of the handle of FIG. 3.

Referring to the drawings, various embodiments of a handle 10 for use on a portable machine, such as a cleaning machine 12 as shown in FIG. 1. The cleaning machine 12 shown and described herein is exemplary only and not to be considered a limitation on this invention. One example of such a cleaning machine 12 is disclosed in U.S. Pat. No. 10,368,710, which is incorporated by reference herein in its entirety. A further example of the cleaning machine 12 on which the handle 10 may be used is Model 1750 offered by KaiVac®, www.kaivac.com.

With reference to FIG. 1, one example of the cleaning machine 12 may include a fresh liquid tank 14, a vacuum tank 16, and an electromechanical assembly 18 releasably connected to the fresh liquid tank 12. The electromechanical assembly 18 may include an electromechanical housing 20, a pump 22, a vacuum motor 24, a control panel assembly 26 and one or more cleaning implements 13.

Referring to FIG. 1, the cleaning machine 12 may have a pair of wheels 28 mounted at the lower end of the assembly 12. The wheels 28 contact a horizontal support surface (e.g., a floor) when the cleaning machine 12 is resting on the horizontal support surface for movement by a user 11 relative to the floor and cleaning thereof or other environmental surfaces, as desired.

The cleaning machine 12 may include a molded machine handle 30 extending laterally in opposite directions from the fresh liquid tank 14 upper portion. Additionally, the cleaning machine 12 may have a pair of molded stubshafts 32 each extending laterally in opposite directions from the fresh liquid tank 14 upper portion. The stubshafts 32 may be used to store and/or suspend a cable, power cord or other component or accessory of the cleaning machine 12, as desired.

A first embodiment of a handle 10 according to this invention is shown in FIGS. 3-6. Any embodiment of the handle 10 according to this invention may be retrofit added to the cleaning machine 12 or provided as original equipment on the cleaning machine 12.

Figure 4:
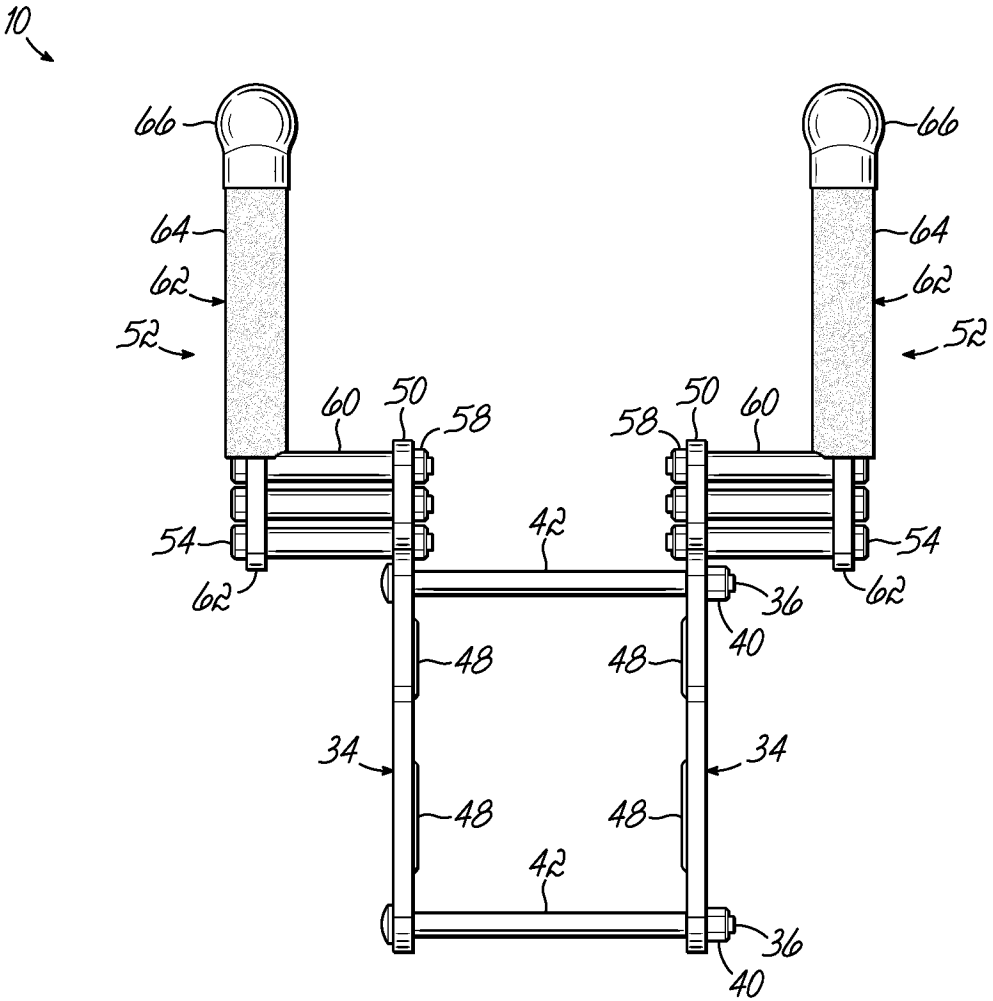
FIG. 4 is a front elevational view of the handle of FIG. 3.
Figure 6:
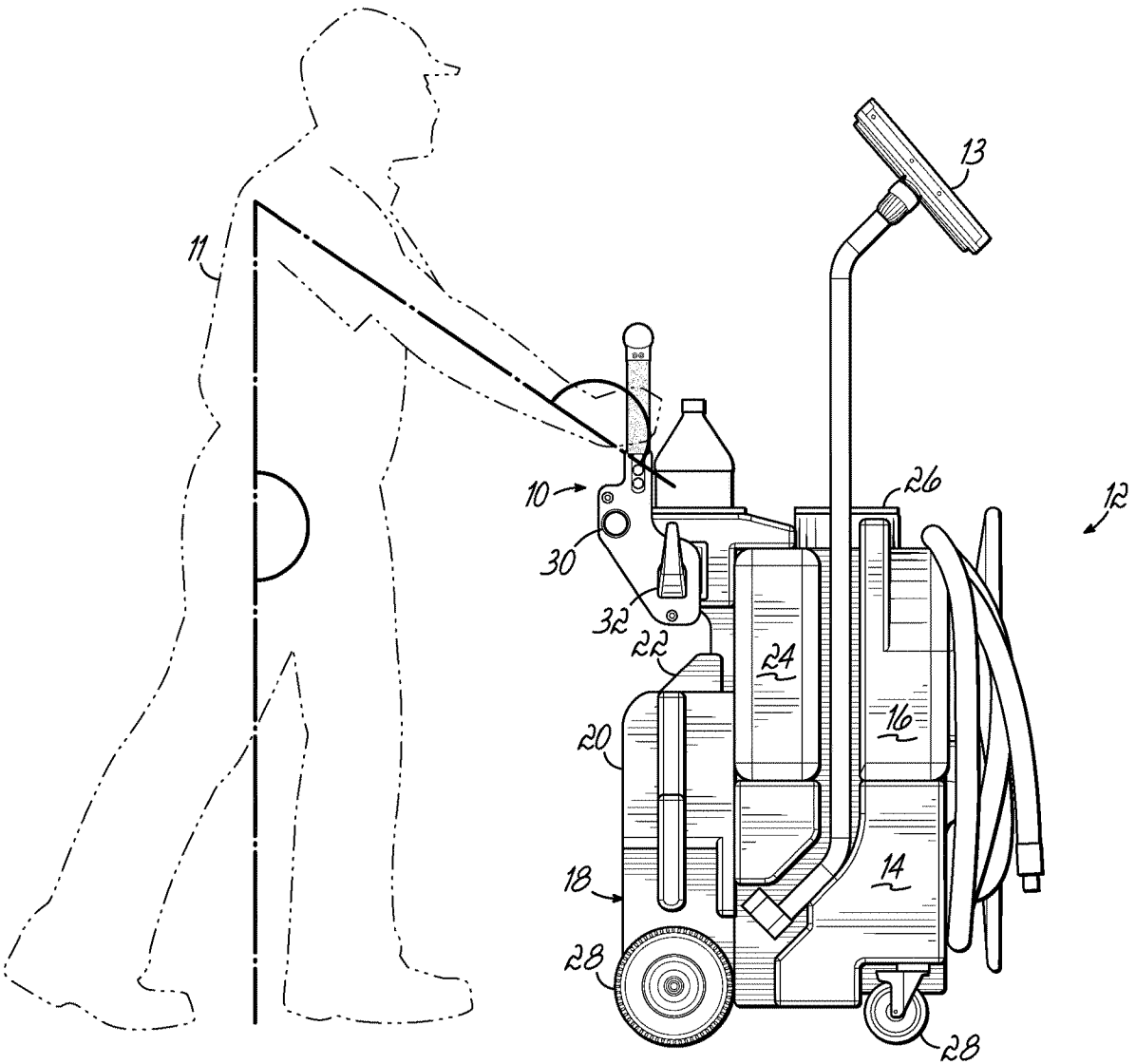
FIG. 6 is a view similar to FIG. 2 with the handle according to one embodiment of this invention installed on the cleaning machine.

The handle 10 of FIGS. 3-6 will be described in further. The handle 10 may include a pair of mounting plates 34 which may be mirror images of one another. The mounting plates 34 are fixed in a spaced relationship as shown in FIG. 4 by a number of threaded rods or bolts 36 which extend through holes 38 in the mounting plates 34. A nuts 40 may be threaded onto each rod 36 against an outer face of one or both mounting plates 34. Tubular spacers 42 may be concentrically mounted on the rods 36 and positioned between the mounting plates 34.

Each mounting plate 34 may have one or more apertures therein, two such apertures 44, 46 are provided in the handle embodiment of FIGS. 3-6. The upper aperture 44 in each mounting plate 34 may be generally circular while the lower aperture 46 of each mounting plate 34 may have a lower generally rectangular profile and an arcuate upper profile. An adhesive backed neoprene bushing 48 may line the aperture 44, 46.

Each mounting plate 34 may have a mast 50 projecting upwardly with a handlebar assembly 52 mounted to an outboard side of the mast 50. A number of threaded rods or bolts 54, three of which are shown in FIGS. 3-6, extend through holes 56 in the mast 50. A nut 56 may be threaded onto each rod 54 against an inner face of the mast 50 on the mounting plate 34. Tubular spacers 60 may be concentrically mounted on the rods 54 and positioned between the mounting plate mast 50 and a post 62 extending downwardly from the handlebar assembly 52. A grip 64 extends upwardly from the post 62 and a knob 66 is located at an upper end of the grip 64. Set screws 68 may secure the knob 66 to the handlebar assembly 52.

The handle 10 of FIGS. 3-6 may be mounted to the cleaning machine 12 by disassembling the rods 36 from the mounting plates 34 and seating each mounting plate 34 on one side of the fresh liquid tank 14 upper portion with the machine handle 30 projecting through the upper aperture 44 and the associated stubshaft 32 projecting through the lower aperture 46. The bushing 48 on each aperture 44, 46 allows for a more secure mounting of the handle 10 on the machine 12. With each mounting plate 34 positioned on the upper portion of the cleaning machine 12 in this manner, the spacers 42 may be positioned between the plates 34 and the rods 36 inserted through the associated holes 38 and spacers 42. The nuts 40 or other fastener may then be tightened on the rods 36 to securely mount the plates 34 on the cleaning machine 12. Once mounted, the handlebar assembly 52 projects upwardly for easy and convenient grasping by a user to push, pull and/or maneuver the cleaning machine 12 easily and with reduced bodily strain due in part to the location of the grips 64.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A handle for use on a cleaning machine, the handle comprising:

a first and a second mounting plate each being spaced from one another when mounted on the cleaning machine;

a first and a second aperture in the first and second mounting plate, respectively, the first and second aperture each having a portion of the cleaning machine projecting therethrough;

a plate spacer extending between the first and second mounting plates to maintain their spaced relationship relative to one another; and a handle member extending upwardly from at least one of the first and second mounting plates and being accessible for a user of the cleaning machine to grasp and manipulate the cleaning machine; and a third and a fourth aperture in the first and second mounting plates, respectively;

wherein a first and a second stubshaft on the cleaning machine projects through the third and fourth apertures, respectively, when the handle is mounted on the cleaning machine.

2. The handle of claim 1 wherein the handle member further comprises:

a first and a second handle member spaced from one another and extending upwardly from the first and second mounting plates, respectively.

3. The handle of claim 2 further comprising:

a first and a second handle member spacer extending between the first handle member and the first mounting plate and the second handle member and the second mounting plate, respectively, to position the first handle member and the second handle member outboard of the associated first mounting plate and the second mounting plate, respectively.

4. The handle of claim 2 wherein the first and second handle members each extend generally vertically upward from the first and second mounting plate, respectively.

5. The handle of claim 1 further comprising:

a grip on the handle member.

6. The handle of claim 1 wherein the handle is selectively mountable and removable from the cleaning machine.

7. The handle of claim 1 wherein a first and a second cleaning machine handle project through the first and second apertures, respectively.

8. The handle of claim 7 wherein the handle member is vertically higher than both the first and second cleaning machine handles when the handle is mounted to the cleaning machine.

9. The handle of claim 1 wherein the first and second apertures are of a configuration different from the third and fourth apertures.

10. A handle for use on a cleaning machine, the handle comprising:

a first and a second mounting plate each being spaced from one another when mounted on the cleaning machine;

a first and a second aperture in the first and second mounting plate, respectively, the first and second aperture each having a portion of the cleaning machine projecting therethrough;

wherein a first and a second cleaning machine handle project through the first and second apertures, respectively, when the handle is mounted to the cleaning machine;

a plate spacer extending between the first and second mounting plates to maintain their spaced relationship relative to one another; and a first and a second handle member spaced from one another and extending generally vertically upward from the first and second mounting plates, respectively, and being accessible for a user of the cleaning machine to grasp and manipulate the cleaning machine;

a first and a second handle member spacer extending between the first handle member and the first mounting plate and the second handle member and the second mounting plate, respectively, to position the first handle member and the second handle member outboard of the associated first mounting plate and the second mounting plate, respectively;

wherein the handle is selectively mountable and removable from the cleaning machine and the first and second handle members are vertically higher than both the first and second cleaning machine handles when the handle is mounted to the cleaning machine; and a third and a fourth aperture in the first and second mounting plates, respectively, wherein a first and a second stubshaft on the cleaning machine projects through the third and fourth apertures, respectively, when the handle is mounted on the cleaning machine, wherein the first and second apertures are of a configuration different from the third and fourth apertures.

11. A combination comprising:

a handle;

a mobile cleaning machine;

wherein the handle is selectively mountable and removable from the cleaning machine;

the handle further comprising (a) a first and a second mounting plate each being spaced from one another when mounted on the cleaning machine;

(b) a first and a second aperture in the first and second mounting plate, respectively, the first and second aperture each having a portion of the cleaning machine projecting therethrough;

(c) a plate spacer extending between the first and second mounting plates to maintain their spaced relationship relative to one another;

(d) a handle member extending upwardly from at least one of the first and second mounting plates and being accessible for a user of the cleaning machine to grasp and manipulate the cleaning machine; and (e) a third and a fourth aperture in the first and second mounting plates, respectively;

wherein a first and a second stubshaft on the cleaning machine projects through the third and fourth apertures, respectively, when the handle is mounted on the cleaning machine.

12. The combination of claim 11 wherein the handle member further comprises:

a first and a second handle member spaced from one another and extending upwardly from the first and second mounting plates, respectively.

13. The combination of claim 12 further comprising:

a first and a second handle member spacer extending between the first handle member and the first mounting plate and the second handle member and the second mounting plate, respectively, to position the first handle member and the second handle member outboard of the associated first mounting plate and the second mounting plate, respectively.

14. The combination of claim 12 wherein the first and second handle members each extend generally vertically upward from the first and second mounting plate, respectively.

15. The combination of claim 11 further comprising:

a grip on the handle member.

16. The combination of claim 11 wherein a first and a second cleaning machine handle project through the first and second apertures, respectively.

17. The combination of claim 16 wherein the handle member is vertically higher than both the first and second cleaning machine handles when the handle is mounted to the cleaning machine.

18. The combination of claim 11 wherein the first and second apertures are of a configuration different from the third and fourth apertures.

* * * * *